United States Patent [19]

Kalt

[11] 4,091,486

[45] May 30, 1978

[54] PUNCH KNOCK-OUT MECHANISM FOR HEADER

[75] Inventor: William E. Kalt, Bay Village, Ohio

[73] Assignee: Kalt Manufacturing Company, North Ridgeville, Ohio

[21] Appl. No.: 798,615

[22] Filed: May 19, 1977

Related U.S. Application Data

[63] Continuation of Ser. No. 659,658, Feb. 20, 1976, abandoned.

[51] Int. Cl.[2] ..... B21D 45/00; B21K 1/44

[52] U.S. Cl. ..... 10/11 E

[58] Field of Search ..... 10/11 R, 11 A, 11 E, 10/12 R, 12.5, 15; 72/427; 74/568

[56] References Cited

U.S. PATENT DOCUMENTS

| | | | |
|---|---|---|---|
| 2,010,378 | 8/1935 | Sassen | 74/568 X |
| 2,469,570 | 5/1949 | Parish | 74/568 X |
| 2,599,053 | 6/1952 | Friedman | 10/12.5 |
| 2,811,871 | 11/1957 | Gaubatz | 74/568 |
| 3,127,626 | 4/1964 | Friedman | 10/12.5 |
| 3,171,144 | 3/1965 | Maistros | 10/11 E |
| 3,214,996 | 11/1965 | Bono | 74/568 |
| 3,299,453 | 1/1967 | Van de Meerendonk | 10/12 R |
| 3,310,822 | 3/1967 | McClellan et al. | 10/12.5 X |
| 3,802,013 | 4/1974 | Nebendorf et al. | 10/11 E |
| 3,919,874 | 11/1975 | Harris | 10/11 R |

*Primary Examiner*—E. M. Combs

*Attorney, Agent, or Firm*—Watts, Hoffmann, Fisher & Heinke Co.

[57] ABSTRACT

A double-blow header, a fixed die, a tool or punch slide, a crankshaft operably connected to the tool slide for reciprocating the tool slide toward and away from the die, a punch carrier movably supported on the tool slide, a plurality of punch assemblies carried by the punch carrier, each of the punch assemblies comprising a punch and punch knock-out pin and a pivoted punch knock-out lever for advancing the punch knock-out pin in the punch when moved in one direction about its pivot, a new and improved punch knock-out actuating mechanism including a reciprocal rod mounted on a fixed part of the machine and extending in the direction of the tool slide, a lever for actuating the punch knock-out levers of the punch assemblies, a pivoted lever arm for moving the reciprocal rod, and an adjustable timing cam operated at one-half the speed of the crankshaft for swinging the lever arm and thereby actuating a knock-out lever of a punch assembly through the rod when the tool slide recedes from the fixed die.

8 Claims, 8 Drawing Figures

PUNCH KNOCK-OUT MECHANISM FOR HEADER

RELATED CASE

This application is a continuation of my copending application Ser. No. 659,658 filed Feb. 20, 1976, now abandoned, entitled PUNCH KNOCK-OUT MECHANISM FOR DOUBLE-BLOW HEADER the disclosure of which is incorporated herein by reference.

BACKGROUND OF THE INVENTION

1. Field of the Invention

This invention relates generally to header machines, and more specifically to the punch knock-out mechanism thereof.

2. Description of the Prior Art

Cold heading machines are conventionally provided with punch knock-out mechanism in order to insure that the blank being headed will remain in the die as the punch slide recedes from the die after a heading blow. One such mechanism is disclosed in U.S. Pat. No. 3,127,626, issued Apr. 7, 1964.

The typical punch knock-out mechanisms of the prior art are relatively complex assemblages of linkages, rocker arms, pivots, reciprocating rods and/or cams, etc. The large number of parts making up the mechanism have prevented their successful use in the smaller size headers, such as ⅛ inch and 3/16 inch machines, which operate at high speeds. Another difficulty is that the prior art mechanisms require frequent repair to keep them in operation.

SUMMARY OF THE INVENTION

An object of the present invention is to provide a new and improved mechanism for actuating the punch knock-out mechanism of a header punch assembly which mechanism overcomes the foregoing difficulties and disadvantages of the prior art and which is capable of performing the required movements at high speeds.

Another object of the present invention is to provide a timed, positive punch knock-out actuating mechanism as described above characterized by a simplified construction consisting of fewer parts then conventional mechanisms.

A further object of the present invention is to provide a punch knock-out actuating mechanism as described above which can be easily adapted to existing headers.

Still another object of the invention is to provide a new and improved trouble-free punch knock-out actuating mechanism as described above which is not subject to the maintenance problems that have been encountered in the past.

The foregoing objects are achieved and the disadvantages of the prior art are overcome by the provision of a novel punch knock-out actuating mechanism for a header comprising a reciprocal rod mounted on the frame of the machine for movement lengthwise of the path of movement of the punch slide and in position to engage the knock-out mechanism of a work-aligned punch assembly, a lever pivoted on the frame of the header for moving the rod and causing it to actuate the knock-out mechanisms of the punch assembly, and a rotatable timing cam driven from the crankshaft of the header for pivoting the lever and thereby actuating the rod when the header tool or punch slide recedes from the fixed die.

In accordance with a preferred embodiment of the invention, the timing of the cam can be adjusted, whereby the punch knock-out actuating mechanism of the present invention can be readily installed on different existing headers. Another feature is the simplicity of the new mechanism. Because of the absence of the multiple number of cams, linkages, pivots, etc. characterizing prior art punch knock-out actuating mechanisms, the mechanism of the present invention can operate at high speeds heretofore not considered practical and can be installed and used successfully on small headers.

Other objects, advantages and a fuller understanding of the invention will be had from the following detailed description of a preferred embodiment and the accompanying drawings.

DESCRIPTION OF THE PREFERRED EMBODIMENT

Figure 1:
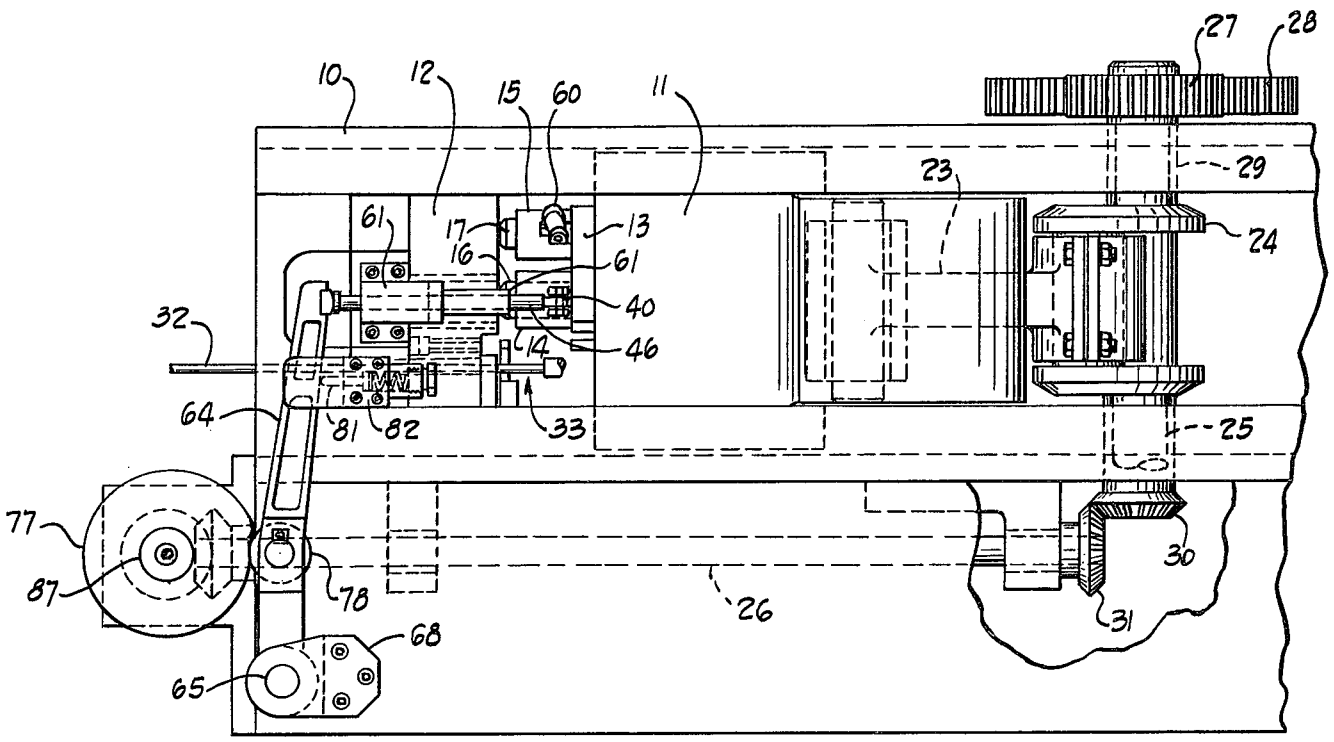
FIG. 1 is a plan view with portions broken away showing a double-blow cold header of conventional construction incorporating the present invention.

Referring to the drawings, and to FIG. 1 in particular, there is shown a double-blow header comprising a bed or frame 10 which supports a horizontally reciprocal tool or punch slide 11 and a fixed die breast 12. A shiftable tool or punch carrier 13 is mounted on the slide 11 and carries a pair of punch assemblies including punch blocks 14, 15. Cold heading punches 16, 17 are supported in the punch blocks 14, 15, respectively, for alternate cooperation with a single die 18 mounted in the die breast 12.

The slide 11 is reciprocated toward and away from the die breast 12 by a connecting rod 23 and a cooperating crank 24 on the main crankshaft 25. The crankshaft 25 is suitably mounted in the frame 10 and driven in a conventional manner. Also mounted in the frame 10 is a shaft 26 which operates the stock shear and transfer mechanism, the die knock-out mechanism the punch knock-out actuating mechanism of the present invention, and the mechanism (not shown) for shifting or oscillating the punch carrier 13 between its two alternate positions in which one or the other of the punches 16 or 17 is aligned with the die 18. The shaft 26 in the depicted header is driven at one-half the speed of the crank-shaft 25 by a pinion 27 on the crank-shaft 25 in mesh with a gear 28 on a shaft 29. The shaft 29 carries a bevel gear 30 in mesh with a bevel gear 31 on the shaft 26.

Wire stock 32 is fed to a shear and transfer mechanism generally designated by reference numeral 33 which operates to cut blanks of measured length and successively transfer them to a position in front of the die 18. As will be understood by those familiar with double-blow cold headers, a blank is positioned in the die 18 on every other stroke of the slide 11. When a new blank has been positioned in the die 18, the tool slide is driven forward to effect a first or preliminary upsetting blow on the blank. Following the first heading blow, the slide 11 retracts and the punch carrier 13 shifted to align the punch 17 with the die 18. The slide 11 is then driven forward a second time to effect a second or final heading blow on the blank. After the heading operation is completed, the header slide 11 retracts, a new blank is aligned with the die 18 and the tool carrier 13 shifted to bring the first punch 16 into alignment with the die 18 for the next operating cycle.

Figure 3:
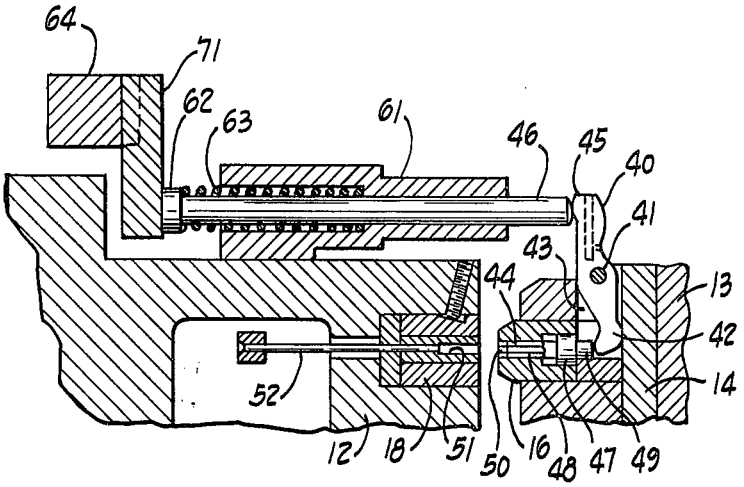
FIG. 3 is a fragmentary cross-sectional view taken on the line 3—3 of FIG. 2.

As shown most clearly in FIG. 3, the punch block 14 is provided with a lever 40 which is mounted by a pivot pin 41. One end 42 of the lever 40 extends into a pocket 43 formed in the punch block 14 and engages the inner end of a longitudinally movable knock-out pin 44 extending within the punch 16. The other end 45 of the lever extends outwardly from the punch block 14 and has a cam surface engageable by a member of a knock-out actuating mechanism to pivot the lever 40 clockwise, as viewed in FIG. 3, so that the opposite end 42 of the lever will push the knock-out pin 44 forwardly in the punch 16, that is, toward the die 18, in timed relation to the retraction of the punch 16 from the die.

In the depicted header, the knock-out pin 44 has a head 47, a forwardly projecting hexagonal shank 48 and a rearwardly extending portion 49 engageable by the lever 40. The head 47 is engageable with longitudinally spaced shoulders or walls in the pocket 43 to limit forward and rearward movement of the pin. In the rearward position shown in FIG. 3, the end of the shank 48 is withdrawn inside the punch 16 to provide a hexagonal cavity 50 in which the head of the blank (not shown) is formed by the heading blows. The shank of the blank is received in the cavity 51 of the die 18 against the end of the movable knock-out pin 52. The pin 52 remains stationery during the heading blows to provide a fixed abutment for the inner end of the blank. It will be understood that various knock-out pins and punch and die assemblies can be substituted for the ones shown in the drawings without departing from the invention.

As shown in FIG. 1, a lever 60 is pivotally mounted in the punch holder 15 in the same manner as the lever 40. The lever 60 is associated with a knock-out pin (not shown) in the punch 17 similar to the knock-out pin 44.

It will be understood that the apparatus and the operation thus far described is conventional and has been described without limitation of the invention simply to disclose one exemplary machine in which the invention can be used to advantage. Reference is made to U.S. Pat. Nos. 3,200,424 and 3,127,626 for a more detailed description of the parts of the exemplary machine heretofore referred to. As will be hereafter made more apparent, the punch knock-out actuating mechanism of this invention is such that it can be readily installed on other types of headers.

In accordance with the present invention, at least one and preferably both of the knock-out mechanisms of the punch assemblies including the punches 16, 17 are actuated by the shaft 26 in timed relation to movement of the slide 11. The knock-outs insure that the blank will be maintained in the die 18 when the slide 11 and the punch then aligned with the die recedes from the die after a heading blow rather than being frictionally retained in the punch.

Figure 2:
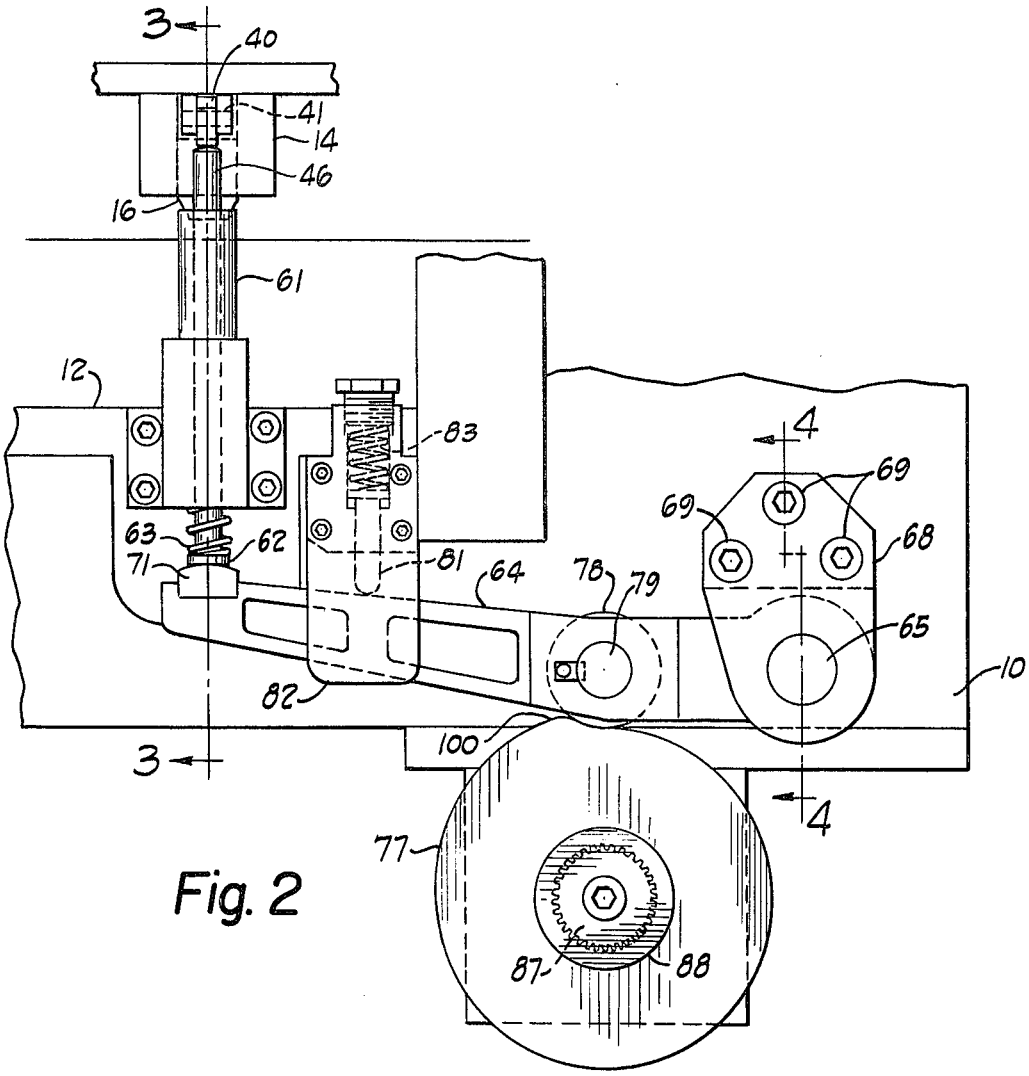
FIG. 2 is an enlarged, fragmentary plan view of a portion of the structure shown in FIG. 1.

According to the present invention a rod 46 is arranged to engage the cam end of one, preferably both of the knock-out pin lever 40 or 60 of the punch assemblies alignable with the die 18 in timed relation to the movement of the tool or punch slide 11. In the depicted header the knock-out punch actuating mechanism of the present invention actuates the knock-out mechanisms of the punch assembly including the punch 16. Referring particularly to FIGS. 2 and 3, the rod 46 is shown to be reciprocally mounted for movement lengthwise of the path of movement of the slide 11 in a housing 61 fixed as by screws to the top of the die breast 12. The rod 46 has a head 62 on its end opposite to the slide 11 and is biased in the direction of the slide 11 by a compression spring 63. The spring 63 is received within a recess of the housing 61 and is engaged between the inner end wall of the recess and the head 62.

Figure 4:
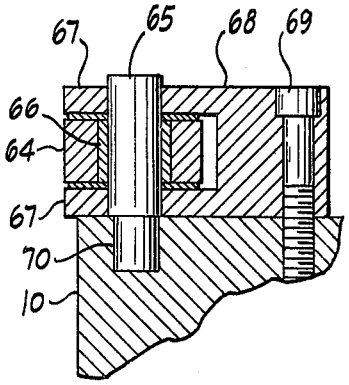
FIG. 4 is a fragmentary cross-sectional view taken on the line 4—4 of FIG. 2.
Figure 5:
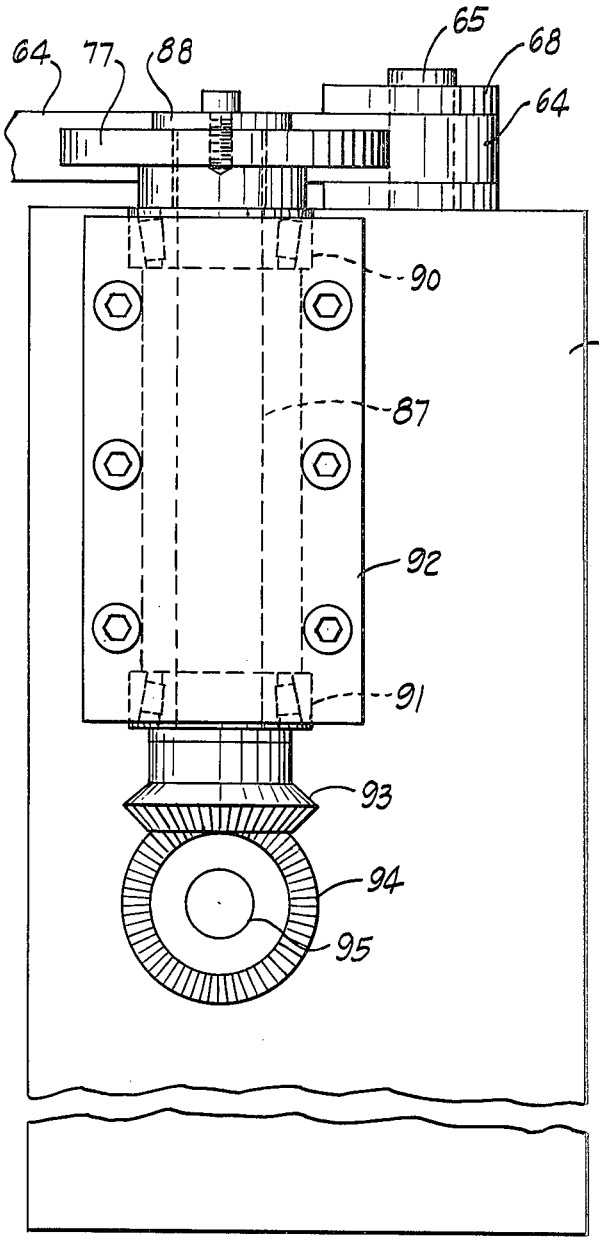
FIG. 5 is a fragmentary elevational view of a portion of the punch knock-out actuating mechanism.
Figure 6:
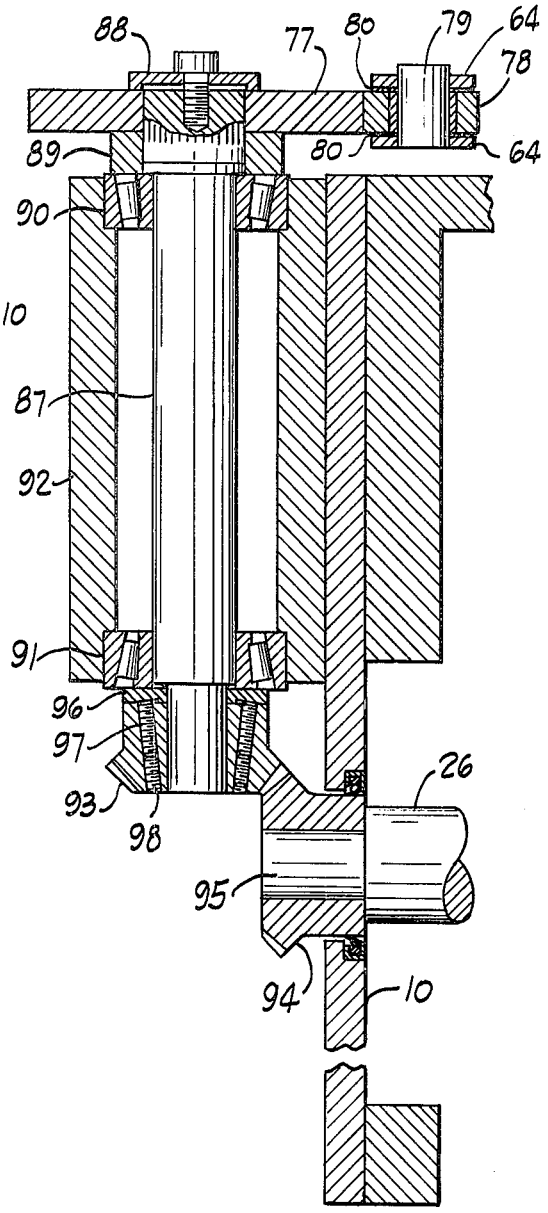
FIG. 6 is a vertical cross-section of the structure shown in FIG. 5.

A lever 64 is pivotally mounted on the top the frame 10 for moving the rod 46 in the direction of the slide 11. As shown most clearly in FIGS. 2 and 4, the end of the lever 64 remote from the rod 46 is journalled on a pivot pin 65 by a sleeve bearing 66. The pivot pin 65 is supported by the legs 64 of a bifurcated bracket 68 that is fixed to the top of the frame 10 by screws 69. The pin 65 has a reduced diameter lower end portion 70 received in a hole in the frame 10. The other end of the lever 64 has a depending portion 71 which engages the head 62 of the rod 46.

Swinging movement is imparted to the arm 64 by a timing cam 77 which engages a roller 78 in an aperture in the arm 64 intermediate its ends. The roller 78 is journalled on a pin 79 which is held in place on the arm 64 by washers 80. A spring-pressed plunger 81 urges the arm 64 counterclockwise, as viewed in FIG. 2, to maintain the roller 78 in engagement with the cam 77. The plunger 81 is reciprocally mounted in a block 82 detachably secured as by screws to the top of the die breast 12 and is pressed against the arm 64 by a spring 83 contained within the block.

The cam 77 is detachably fixed to the top of a rotatable shaft 87 between a washer 88 and a spacer 89. The cam shaft 87 is mounted for rotation by upper and lower roller bearing assemblies 90, 91, respectively, within a vertical bearing mount 92 secured as by screws to the end of the frame 10 opposite to the crankshaft. A bevel gear 93 is mounted on the lower end of the cam shaft 87 in meshing engagement with a bevel gear 94 on an end portion 95 of the shaft 26. The lower roller bearing assembly 91 is held in place by a retaining ring 96 which is acted on by screws 97 carried in the bevel gear 93. The adjustable screws 97 are locked in place by locking screws 98.

Figure 7:
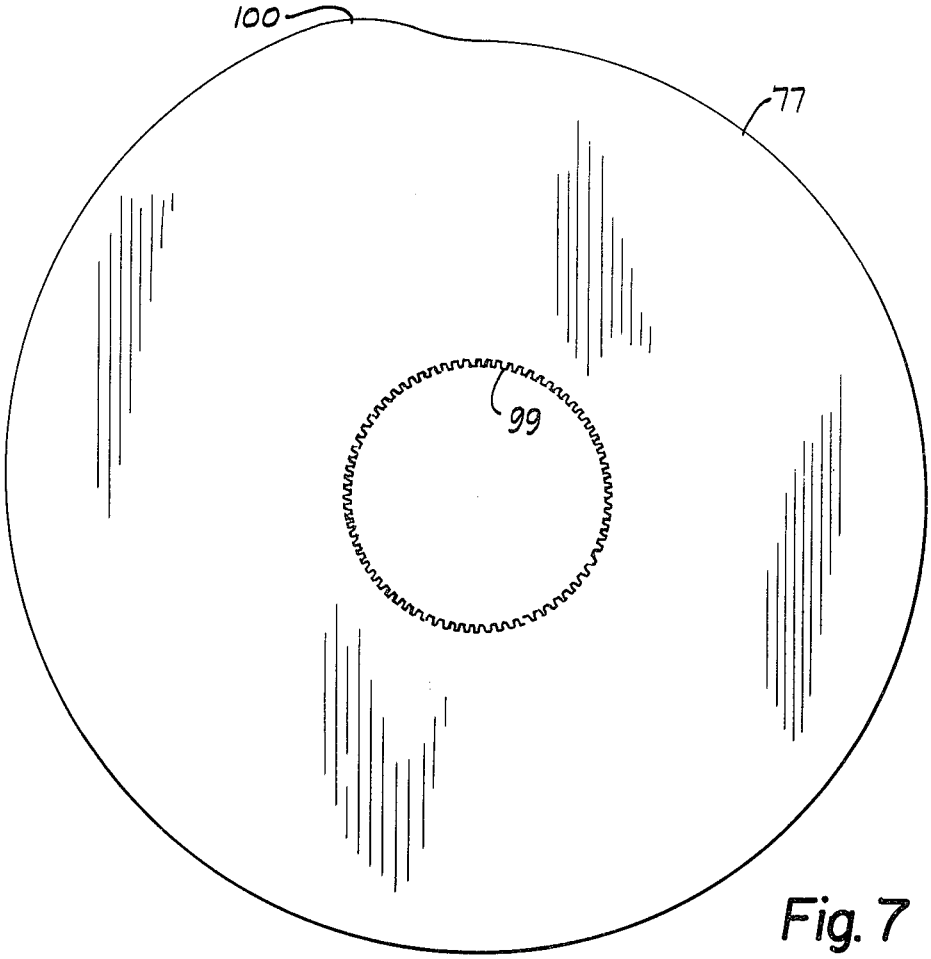
FIG. 7 us an enlarged plan view of a timing cam which forms a part of the punch knock-out actuating mechanism; and, FIG. 8 is an enlarged fragmentary view of a portion of the structure shown in FIG. 6.
Figure 8:
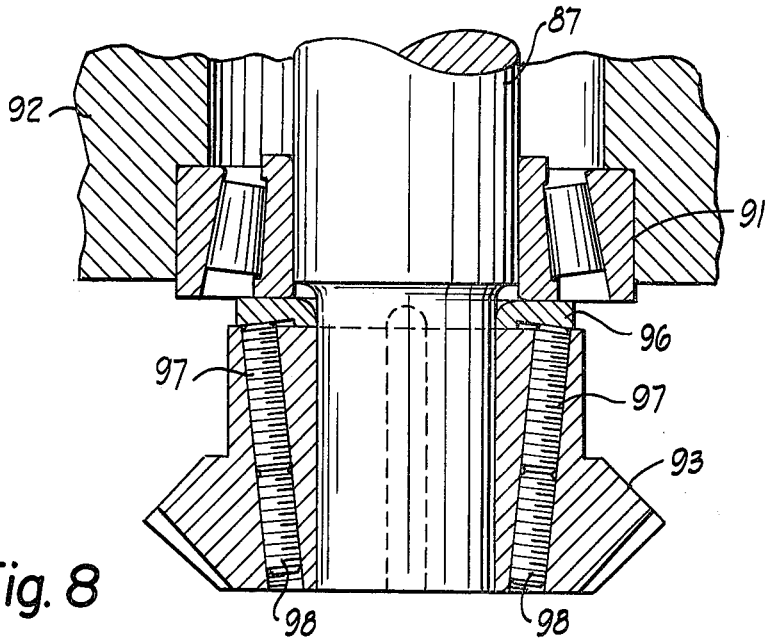

The action of the cam 77 is timed to swing the arm 64 clockwise, as viewed in FIG. 2, and actuate the punch knock-out mechanism of the punch assembly as the header slide 11 recedes from the die breast. It will be understood that it may be desired to change the timing of the punch knock-out actuating mechanism depending upon the operating speed of the particular machine on which the new punch knock-out actuating mechanism of this invention is installed. To this end, the upper end of the cam shaft 87 is splined and the inner diameter of the cam is formed with a desired number of spline-engaging teeth 99 (FIG. 7). In a preferred construction, the cam 77 has 82 teeth to provide timing in 4.39° increments.

The operation of the punch knock-out actuating mechanism of the invention will be largely apparent from the foregoing description. In summary, during movement of the punch slide 11 away from the die breast 12, the lobe 100 of the cam 77 is rotated into engagement with the roller 78 on the lever 64. This causes the lever 64 to swing clockwise as viewed in FIG. 2 and move the rod 46 toward the receding slide 11. The shape of the cam 77 is such that the rod 46 overtakes the slide 11 and rocks the knock-out lever of the die assembly which lever is in the path of the rod, e.g., the lever 40 in FIG. 3, whereby the knock-out pin is moved forwardly in the punch to insure that the blank is released and maintained in the die 18.

It will be seen that the invention achieves the objective of providing a knock-out mechanism which is especially adapted for use in conjunction with small, double-blow high speed cold headers. The mechanism is characterized by a simplified arrangement of a limited number of parts which avoids the complex construction of linkages, pivots and cams presently found in conventional knock-out mechanisms. The new simplified construction makes it possible to transmit the required motion at high speeds heretofore not possible.

Many variations and modifications of the invention will be apparent to those skilled in the art in view of the foregoing detailed disclosure. Therefore, it is to be understood that, within the scope of the appended claimes, the invention can be practiced otherwise than as specifically shown and described.

What is claimed is:

1. In a header having a frame including a fixed die support, a tool slide supported by the frame for lineal movement toward and away from the die support, a crankshaft rotatably supported by the frame and operably connected to the tool slide for reciprocating the tool slide toward and away from the die support, a punch assembly carried by the tool slide including a punch aligned with a die carried by the die support and a punch knock-out pin and a pivoted punch knock-out lever for advancing the punch knock-out pin when moved in one direction about its pivot, a knock-out actuating shaft driven by the crankshaft and extending parallel with the path of movement of the tool slide, a knock-out lever actuating mechanism comprising: a first housing, a rod slidably supported by said housing and extending from one side thereof, means for connecting said first housing to the frame of the header adjacent to the die support with said rod slidably supported thereby extending toward the tool slide and in alignment with and in position when moved in one direction to contact the knock-out lever of the punch assembly of the header, a spring acting on said rod to urge it in the direction opposite to said one direction, a lever pivotally connected to the frame of the header and having one end engaged with said rod for moving said rod against the force of said spring, the other end of said lever being connected to the frame of the header, a second housing, means for connecting said second housing to the frame of the header, a cam shaft rotatably supported by said second housing, gearing on said cam shaft for connection to the knock-out actuating shaft of the header, a cam on said cam shaft for moving said lever about its pivot for moving said rod in said one direction in timed relation to the movement of said tool slide to engage the knock-out lever of the punch assembly of the header as the tool slide moves away from the die support.

2. In a header having a frame including a fixed die support, a tool slide supported by the frame for lineal movement toward and away from the die support, a crankshaft rotatably supported by the frame and operably connected to the tool slide for reciprocating the tool slide toward and away from the die support, a punch carrier movably supported on the tool slide, a plurality of punch assemblies carried by said punch carrier, each of said punch assemblies including a punch and a punch knock-out pin and a pivoted punch knock-out lever for advancing the punch knock-out pin when moved in one direction about its pivot, mechanism for sequentially aligning punches carried by the punch assemblies with a die carried by the die support, a knock-out actuating shaft driven by the crankshaft and extending parallel with the path of movement of the tool slide, a knock-out lever actuating mechanism comprising: a first housing, a rod slidably supported by said housing and extending from one side thereof, means for connecting said first housing to the frame of the header adjacent to the die support with said rod slidably supported thereby extending toward the tool slide and in alignment with and in position when moved in one direction to contact the knock-out lever of a punch assembly in alignment with a die in the die support, a spring acting on said rod to urge it in the direction opposite to said one direction, a lever pivotally connected to the frame of the header and having one end engaged with said rod for moving said rod against the force of said spring, means for connecting the other end of said lever to the frame of the header, a second housing, means for connecting said second housing to the frame of the header, a cam shaft rotatably supported by said second housing, gearing on said cam shaft for connection to the knock-out actuating shaft of the header, a cam on said cam shaft for moving said lever about its pivot for moving said rod in said one direction in timed relation to the movement of said tool slide to engage the knock-out lever of the punch assembly of the header aligned therewith as the tool slide moves away from the die support.

3. In a header having a frame including a fixed die support, a tool slide supported by the frame for lineal movement toward and away from the die support, a crankshaft rotatably supported by the frame and operably connected to the tool slide for reciprocating the tool slide toward and away from the die support, a punch assembly carried by the tool slide including a punch aligned with a die carried by the die support and a punch knock-out pin and a pivoted punch knock-out lever for advancing the punch knock-out pin when moved in one direction about its pivot, a knock-out actuating shaft driven by the crankshaft and extending parallel with the path of movement of the tool slide, a knock-out lever actuating mechanism comprising: a first housing, a rod slidably supported by said housing and extending from one side thereof, means for connecting said first housing to the top of the frame of the header adjacent to the die support with said rod slidably supported thereby extending toward the tool slide and in alignment with and in position when moved in one direction to contact the knock-out lever of the punch assembly of the header, a spring acting on said rod to urge it in the direction opposite to said one direction, a lever pivotally connected to the top of the frame of the header and having one end engaged with said rod for moving said rod against the force of said spring, means for connecting the other end of said lever to the top of the frame of the header, a second housing, means for connecting said second housing to the end of the frame of the header at which the die support is located, a cam shaft rotatably supported by said second housing, gearing on said cam shaft for connection to the knock-out actuating shaft of the header, a cam on said cam shaft for moving said lever about its pivot for moving said rod in said one direction in timed relation to the movement of said tool slide to engage the knock-out lever of the punch assembly of the header as the tool slide moves away from the die support.

4. In a header having a frame including a fixed die support, a tool slide supported by the frame for lineal movement toward and away from the die support, a crankshaft rotatably supported by the frame and operably connected to the tool slide for reciprocating the tool slide toward and away from the die support, a punch carrier movably supported on the tool slide, a plurality of punch assemblies carried by the punch carrier, each of the punch assemblies including a punch and a punch knock-out pin and a pivoted punch knock-out lever for advancing the punch knock-out pin when moved in one direction about its pivot, mechanism for sequentially aligning punches carried by the punch assemblies with a die carried by the die support, a knock-out actuating shaft driven by the crankshaft and extending parallel with the path of movement of the tool slide, a knock-out lever actuating mechanism comprising: a first housing, a rod slidably supported by said housing and extending from one side thereof, means for connecting said first housing to the top of the frame of the header adjacent to the die support with said rod slidably supported thereby extending toward the tool slide and in alignment with and in position when moved in one direction to contact the knock-out lever of a punch assembly in alignment with a die in the die support, a spring acting on said rod to urge it in the direction opposite to said one direction, a lever pivotally connected to the top of the frame of the header and having one end engaged with said rod for moving said rod against the force of said spring, means for connecting the other end of said lever to the top of the frame of the header, a second housing, means for connecting said second housing to the end of the frame of the header adjacent to the die support, a cam shaft rotatably supported by said second housing, gearing on said cam shaft for connection to the knock-out actuating shaft of the header, a cam on said cam shaft for moving said lever about its pivot for moving said rod in said one direction in timed relation to the movement of said tool slide to engage the knock-out lever of the punch assembly of the header aligned therewith as the tool slide moves away from the die support.

5. A device as claimed in claim 1 including means for angularly adjusting the cam relative to the cam shaft.

6. A device as claimed in claim 2 including means for angularly adjusting the cam relative to the cam shaft.

7. A device as claimed in claim 3 including means for angularly adjusting the cam relative to the cam shaft.

8. A device as claimed in claim 4 including means for angularly adjusting the cam relative to the cam shaft.

* * * * *